United States Patent [19]

Martucci

[11] Patent Number: 4,732,566

[45] Date of Patent: Mar. 22, 1988

[54] ELECTROCUTION PROOF LINE AND EXTENSION CORD

[76] Inventor: Frank Martucci, 360 Tom Hunter Rd., Fort Lee, N.J. 07024

[21] Appl. No.: 63,408

[22] Filed: Jun. 18, 1987

[51] Int. Cl.[4] ..... H01R 4/66

[52] U.S. Cl. ..... 439/106; 439/92

[58] Field of Search ..... 439/92, 103, 105, 106, 439/502

[56] References Cited

U.S. PATENT DOCUMENTS 4,025,139 5/1977 Martucci ..... 439/106

4,417,196 11/1983 Cueto et al. ..... 439/106

FOREIGN PATENT DOCUMENTS 2576720 8/1986 France ..... 439/92

*Primary Examiner*—Eugene F. Desmond

*Attorney, Agent, or Firm*—Peter C. Michalos

[57] ABSTRACT

A power line includes a plug having four wire connection sites and a line cord having four conductors each conducted to a respective wire connection site. Two of the sites are connected to the two power conducting blades of the plug and the remaining two wires are connected to a single grounding prong of the plug. An extension cord can be made by attaching a female socket to opposite ends of the wires, the female socket also having four wire connection sites. The plug and line cord can also be connected directly to a device having four wire connection sites.

4 Claims, 5 Drawing Figures

FIG. 1
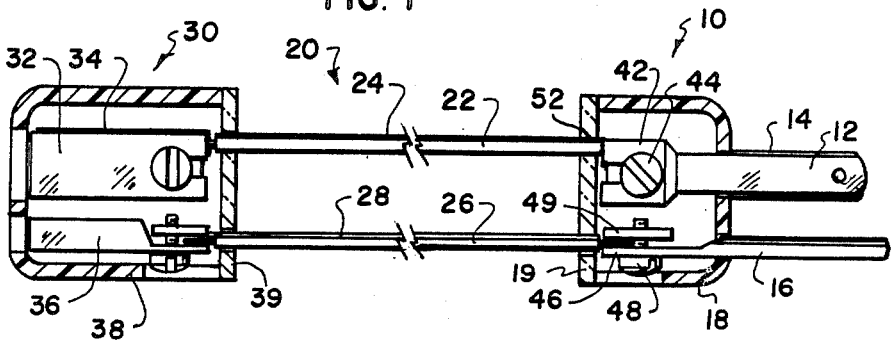
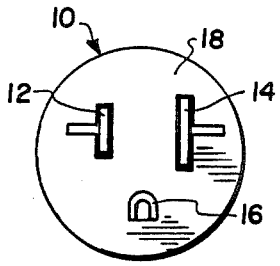
FIG. 2
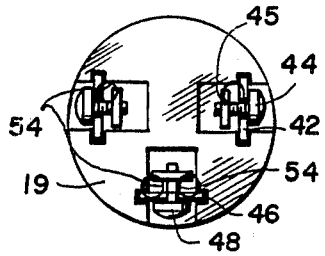
FIG. 3
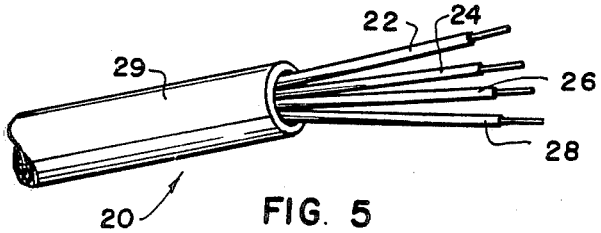
FIG. 5
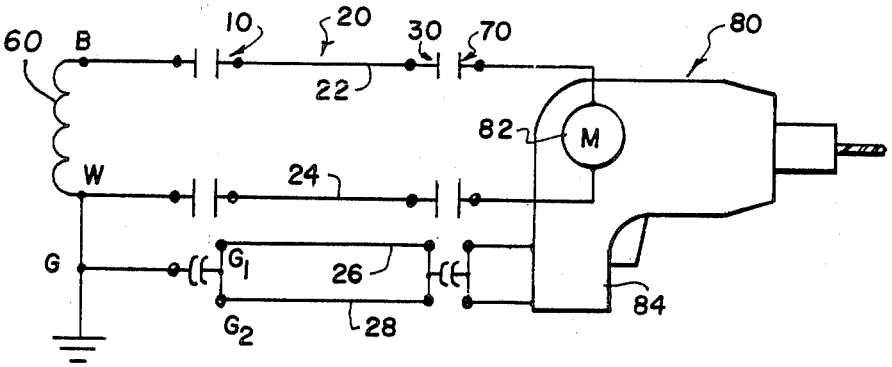
FIG. 4

ELECTROCUTION PROOF LINE AND EXTENSION CORD

FIELD AND BACKGROUND OF THE INVENTION

The present invention relates in general to three prong extension and power lines, and in particular, to a new and useful three prong extension and power line having a redundant ground connection.

Extension cords and power lines for many electrical appliances and devices which are designed to operate on 120 volt single phase power, often include two blade shaped prongs which are respectively connected to hot and neutral poles of the one phase power supply. A ground is often also used for a plug and socket of such lines and extension cords, which is connected to the neutral terminal of the power supply. This neutral terminal is grounded so that the third prong acts as a ground connection for the electrical device or appliance.

The ground prong is electrically connected to the housing or any exposed metal surfaces of the appliance or device. In case an accidental bridge is formed between the hot terminal of the power supply and the housing, electricity flows through the ground prong to the ground connection of the power supply. This avoids having the electricity go through a person holding the housing, resulting in electrocution.

The foregoing system operates correctly as long as the proper terminals of the power supply are connected to the proper terminals of the extension cord or appliance.

It often occurs, however, that improper connections are made to the power supply. The most common error is to reverse the hot and neutral connections. While this may seem to be an innocuous error, in view of the fact that the power supply is alternating current, this error can lead to electrocution if it is compounded by other errors in wiring the extension cord or power line of the appliance.

These types of errors in wiring have often been linked with unexplained electrocutions. Such electrocutions often happen in a hospital environment. A large number of appliances and devices are wired and used in a hospital. This increases the chances for wiring errors and thus the chance of inadvertently electrocuting a patient who is utilizing the devices.

In an attempt to avoid these problems, the present inventor proposed in U.S. Pat. No. 4,025,139, a redundant electrical grounding system which utilized an extra ground prong and an additional wire. This use of a redundant ground would thus minimize the chances of error in wiring both the power supply and the power cord for an appliance.

This invention did not meet with commercial success, however, since the industry was reluctant to abandon the conventional three prong arrangement for wall plugs.

In the meantime, however, reports of unexplained electrocutions have continued.

In the April 1982 issue of *Science Digest*, an article entitled "Cures That Kill" disclose how some deaths rather than being caused by a disease for which the patient was being treated, was actually caused by inadvertent electrocution.

A June 18, 1985 article in the *STAR* reported an investigation conducted by Ralph Nader into the medical profession concerning the accidental electrocution of 5000 patients a year of electrical equipment.

Reports of unexplained electrocutions continue to the present day.

Many, if not all, of these can be traced to improper wiring. If, in fact, a correctly grounded electrical device were utilized, these types of electrocutions would not be possible.

Conventional three prong plugs, having a narrow blade for the hot connection, usually carrying a black wire, a broad blade for the neutral connection, usually carrying a white wire, and a grounding prong for a ground connection, usually carrying a green wire, can be conencted to a three wire line in six possible ways, only one of which being the correct connection. In other words, the black and white wires may be reversed. The white and black wires may be reversed, etc. This plug, whether it is correctly wired or not, can be inserted into an outlet which itself may be correctly wired or not.

By the same token, a female connector body of an extension cord can be wired in one correct way and five incorrect ways.

The various combinations which are possible yield one perfectly correct wiring combination (labeled OK in the following tables), several improperly wired yet generally safe combinations (where a dash appears in the table) or the immediate hazard of electrocution (labeled X in the following tables).

In each of the tables, the left-hand column starts at the top with the piece of hardware to be wired (whether it is the male plug of the device or an extension cord, or the female socket of the extension cord), each with a black (B), white (W) and ground (G) screw or connecting site. Below the listing of these connecting sites are the color designations of three wires which can be connected to these sites. While normally these wires are black, white and green, respectively, many line cords and wires have uncolored and undistinguishable wires. Add to this the fact that many dozens of pieces of equipment and extension cords may be assembled at one sitting, and the possibility of making any one of the errors in wiring exists.

It is interesting to note in Tables 2 and 3, that even properly wired extension cords can act as an conduit to cause an electrocution. An investigation would not reveal the true cause of heart failure and an electrocution could go undetected.

TABLE 1

| Male 3 Wire Plug and Line Cord to be Connected to a Device | | | | |
|---|---|---|---|---|
| Plug Con. Sites | | | Properly Wired | Reverse Polarity |
| B | W | G | Outlet | Outlet |
| B | W | G | OK | — |
| B | G | W | — | X |
| W | B | G | — | — |
| W | G | B | — | X |
| G | B | W | X | — |
| G | W | B | X | — |

B = Black Site or Wire
W = White Site or Wire
G = Ground Site or Wire
OK = Correct Wiring, No Hazard
— = Incorrect Wiring, No hazard
X = Incorrect Wiring, Electrocution Hazard

TABLE 2

| Plug Con. Site | | | Male 3 Wire Plug and Line Cord to be Part of an Extension Cord | | | |
|---|---|---|---|---|---|---|
| B | W | G | Proper Outlet | Rev. Pola. Outlet | Proper Outlet Device with Rev. G & W | Rev. Outlet Device with Rev. G & W |
| B | W | G | OK | — | — | X |
| B | G | W | — | X | — | — |
| W | B | G | — | — | X | — |
| G | B | W | X | — | — | X |
| W | G | B | — | X | X | — |
| G | W | B | X | — | — | X |

TABLE 3

| Socket Con. Site | | | Female 3 Wire (Socket) Connector and Line Cord to be Part of an Extension Cord | | | |
|---|---|---|---|---|---|---|
| B | W | G | Proper Outlet | Rev. Pola. Outlet | Proper Outlet Device with Rev. G & W | Rev. Outlet Device with Rev. G & W |
| B | W | G | OK | — | — | X |
| B | G | W | — | X | — | — |
| W | B | G | — | — | X | — |
| W | G | B | X | — | — | — |
| G | B | W | — | X | X | — |
| G | W | B | X | — | — | X |

These tables are presented to show the possible errors that can be made in wiring, and the sometimes dire results which may come about. These dangers of electrocution are compounded by mechanical failures that could also occur in the devices, such as the case where the hot or black wire is frayed or damaged and makes inadvertent contact with the metal casing or chassis of the device.

It is noted that the tables show the possibility of electrocutions where perfectly good outlets and devices are utilized, but where the errors are in how they are wired.

The X designation for an electrocution hazard means that 120 volts are available directly at the device chassis or housing. In the case of a drill having a metal handle for example, this would mean that any person holding the drill would be directly connected to 120 volts. The actual passage of current through the person would rely on how well insulated the person is from the ground. If, for example, a person is standing in water, immediate electrocution would most likely occur.

SUMMARY OF THE INVENTION

The present invention involves a scheme and apparatus for preventing electrocutions due to any combination of improper wiring. When line or extension connections are improperly wired, the fourth conductor and connecting site will automatically remove lethal charges. When properly wired, the fourth conductor and site will provide the benefits of grounding redundancy.

A main objective of the invention is to provide a system which can be used with conventional existing three prong 120 volt outlets. Since no major changes would have to made to existing outlets, it is expected that the present invention will receive greater interest. If the present invention is in fact adopted and utilized, the hazards of inadvertent electrocution due to miswiring would be totally eliminated.

This will be demonstrated in following additional tables showing the possible ways that the inventive plugs and connectors can be wired, including one correct and many incorrect ways, and demonstrating that regardless of how the connectors and plugs are wired, electrocution will never occur. At worst the circuit breaker or fuse of the outlet will be tripped or blown. In 75% of the cases which involve an extension cord, the short will not even pass beyond the extension cord.

In other words, the extension cord itself will trip the circuit breaker, preventing current to be transmitted to the device.

In its simplest form, the present invention involves the addition of a second ground connection site on the male plug and/or female connector for the line cord of a device or for an extension cord. This additional site is used in combination with an additional ground wire in the line or extension cord.

The use of a four wire line plus a plug or connector having four connecting sites, positively removes the chance of inadvertent electrocution. At worst, the fuse or the circuit breaker of the outlet will be blown. This is certainly preferable to the inadvertent electrocution of a person touching or otherwise using the device.

As with tables 1 through 3 above, each of the plugs or connectors is assumed to have a plurality of connecting sites or connecting screws. As with the prior art, a black (B) and white (W) site is provided for the hot and neutral power terminals respectively. Instead of the single ground connecting site, however, two ground connecting sites $G_1$ and $G_2$ are used.

These plugs and connectors are used in conjunction with a four wire cord having black, white, $G_1$ and $G_2$ wires.

It will be observed that throughout the following tables, no instance of electrocution or potential electrocution (X in Tables 1, 2 and 3) will result. The designation BF in each appropriate location of the following Tables signifies that the 120 volt potential is removed from the electrical device itself by blowing the fuse or opening the circuit breaker of the power outlet.

The designation BC also indicates the blowing of a fuse or circuit breaker. In these cases, the 120 volt potential is removed before it even reaches the device in question. In other words, the potential is removed within the extension cord itself and never reaches the grounded housing or chassis of the device that is being powered by the extension cord.

TABLE 4

| Plug Connection Sites | | | | Electrocution-Proof Plug and Line Cord to be Connected to a Device | |
|---|---|---|---|---|---|
| B | W | $G_1$ | $G_2$ | Properly Wired Outlet | Reverse Polarity Outlet |
| B | W | $G_1$ | $G_2$ | OK | — |
| B | W | $G_2$ | $G_1$ | OK | — |
| B | $G_1$ | W | $G_2$ | — | BF |
| B | $G_1$ | $G_2$ | W | — | BF |
| B | $G_2$ | W | $G_1$ | — | BF |
| B | $G_2$ | $G_1$ | W | — | BF |
| W | B | $G_1$ | $G_2$ | — | — |
| W | B | $G_2$ | $G_1$ | — | — |
| W | $G_1$ | B | $G_2$ | — | BF |
| W | $G_1$ | $G_2$ | B | — | BF |
| W | $G_2$ | $G_1$ | B | — | BF |
| W | $G_2$ | B | $G_1$ | — | BF |
| $G_1$ | B | W | $G_2$ | BF | — |
| $G_1$ | B | $G_2$ | W | BF | — |
| $G_1$ | W | B | $G_2$ | BF | — |
| $G_1$ | W | $G_2$ | B | BF | — |
| $G_1$ | $G_2$ | W | B | BF | BF |
| $G_1$ | $G_2$ | B | W | BF | BF |
| $G_2$ | B | W | $G_1$ | BF | — |
| $G_2$ | B | $G_2$ | W | BF | — |
| $G_2$ | W | B | $G_2$ | BF | — |
| $G_2$ | W | $G_2$ | B | BF | — |

TABLE 4-continued

| Electrocution-Proof Plug and Line Cord to be Connected to a Device | | | | | |
|---|---|---|---|---|---|
| Plug Connection Sites | | | | Properly Wired | Reverse Polarity |
| B | W | $G_1$ | $G_2$ | Outlet | Outlet |
| $G_2$ | $G_1$ | W | B | BF | BF |
| $G_2$ | $G_1$ | B | W | BF | BF |

combined to produce various results. In no case, however, is there a danger of electrocution.

It is noted that the present invention can also be applied to 220 volt power supplies.

The broad concept of the invention is the provision in the plug and on the socket of four connecting sites, in conjunction with four conductors or wires in a line cord. Even if while wiring the plugs or sockets, an error is made, and this error goes undetected, no electrocution hazard will occur even if the plug and socket are

TABLE 5

| Plug Con. Sites | | | | Electrocution-Proof Plug and Line Cord to be Part of an Extension Cord | | | |
|---|---|---|---|---|---|---|---|
| | | | | Proper Outlet, Proper | Rev. Pola. Outlet, | Proper Outlet, Rev. | Rev. Pola. Outlet, Rev. |
| B | W | $G_1$ | $G_2$ | Device | Prop. Device | G & W Device | G & W Device |
| B | W | $G_1$ | $G_2$ | OK | — | — | BF |
| B | W | $G_2$ | $G_1$ | — | — | — | BF |
| B | $G_1$ | W | $G_2$ | — | BC | — | BC |
| B | $G_1$ | $G_2$ | W | — | BC | — | BC |
| B | $G_2$ | W | $G_1$ | — | BC | — | BC |
| B | $G_2$ | $G_1$ | W | — | BC | — | BC |
| W | B | $G_1$ | $G_2$ | — | — | BF | — |
| W | B | $G_2$ | $G_1$ | — | — | BF | — |
| W | $G_1$ | B | $G_2$ | — | BC | BF | BC |
| W | $G_1$ | $G_2$ | B | — | BC | BF | BC |
| W | $G_2$ | $G_1$ | B | — | BC | BF | BC |
| W | $G_2$ | B | $G_1$ | — | BC | BF | BC |
| $G_1$ | B | W | $G_2$ | BC | — | BC | — |
| $G_1$ | B | $G_2$ | W | BC | — | BC | — |
| $G_1$ | W | B | $G_2$ | BC | — | BC | BF |
| $G_1$ | W | $G_2$ | B | BC | — | BC | BF |
| $G_1$ | $G_2$ | W | B | BC | BC | BC | BC |
| $G_1$ | $G_2$ | B | W | BC | BC | BC | BC |
| $G_2$ | B | W | $G_1$ | BC | — | BC | — |
| $G_2$ | B | $G_1$ | W | BC | — | BC | — |
| $G_2$ | W | B | $G_2$ | BC | — | BC | BF |
| $G_2$ | W | $G_1$ | B | BC | —BC | BF | |
| $G_2$ | $G_1$ | W | B | BC | BC | BC | BC |
| $G_2$ | $G_1$ | B | W | BC | BC | BC | BC |

| Socket Con. Sites | | | | Electrocution-Proof Socket and Line Cord To Be Part of an Extension Cord | | | |
|---|---|---|---|---|---|---|---|
| | | | | Proper Outlet, Proper | Rev. Pola. Outlet, Proper | Proper Outlet, Rev. | Rev. Pola. Outlet, Dev. |
| B | W | $G_1$ | $G_2$ | Device | Device | G & W Device | G & W Device |
| B | W | $G_1$ | $G_2$ | OK | — | — | BF |
| B | W | $G_2$ | $G_1$ | — | — | — | BF |
| B | $G_1$ | W | $G_2$ | — | BC | — | BC |
| B | $G_1$ | $G_2$ | W | — | BC | — | BC |
| B | $G_2$ | W | $G_1$ | — | BC | — | BC |
| B | $G_2$ | $G_1$ | W | — | BC | — | BC |
| W | B | $G_1$ | $G_2$ | — | — | BF | — |
| W | B | $G_2$ | $G_1$ | — | — | BF | — |
| W | $G_1$ | B | $G_2$ | BC | — | BC | — |
| W | $G_1$ | $G_2$ | B | BC | — | BC | — |
| W | $G_2$ | $G_1$ | B | BC | — | BC | — |
| W | $G_2$ | B | $G_1$ | BC | — | BC | — |
| $G_1$ | B | W | $G_2$ | — | BC | BF | BC |
| $G_1$ | B | $G_2$ | W | — | BC | BF | BC |
| $G_1$ | W | B | $G_2$ | BC | — | BC | BF |
| $G_1$ | W | $G_2$ | B | BC | — | BC | BF |
| $G_1$ | $G_2$ | W | B | BC | BC | BC | BC |
| $G_1$ | $G_2$ | B | W | BC | BC | BC | BC |
| $G_2$ | B | W | $G_1$ | — | BC | BF | BC |
| $G_2$ | B | $G_1$ | W | — | BC | BF | BC |
| $G_2$ | W | B | $G_1$ | BC | — | BC | BF |
| $G_2$ | W | $G_1$ | B | BC | — | BC | BF |
| $G_2$ | $G_1$ | W | B | BC | BC | BC | BC |
| $G_2$ | $G_1$ | B | W | BC | BC | BC | BC |

Table 4 through 6 show how correctly, and incorrectly wired plugs, sockets, outlet and devices, can be subsequently used with improperly wired outlet and devices.

Accordingly, an object of the present invention is to provide an electrocution-proof line, comprising a plug having a housing with four wire connection sites, a first conductive blade extending from said housing and being connected to a first one of said sites, a second conductive blade extending from said housing and connected to a second one of said sites, a grounding prong extending from said housing and connected to a third and fourth one of said sites, and a line cord having four conductive wires connected respectively to said first, second, third and fourth sites, whereby electrical current applied to said first and second conductive blades passes through said first and second sites, and said third and fourth sites act as redundant grounding paths for any fault current passing to said grounding prong.

A further object of the invention is to provide a socket having four wire connector sites, two of said sites being connected to first and second blade receptacles of said socket, with the third and fourth sites being connected to a grounded prong receptacle, said four sites of said socket being connected respectively to said four conductive wires of said line cord.

A still further object of the invention is to provide an electrocution-proof line having a plug with or without a socket, and which is simple in design, rugged in construction and economical to manufacture, while providing a secure and error-proof redundant grounding connection.

BRIEF DESCRIPTION OF THE DRAWINGS

In the drawings:

FIG. 1 is a longitudinal sectional view of the electrocution-proof line in accordance with the present invention, having a plug and socket and forming an extension cord;

FIG. 2 is a front elevational view of the plug of FIG. 1;

FIG. 3 is a rear elevational view of the plug of FIG. 1;

FIG. 4 is a schematic circuit diagram showing how a device such as a drill, is connected to the extension cord of the present invention; and FIG. 5 is a partial perspective view of a line cord used in accordance with the present invention.

DESCRIPTION OF THE PREFERRED EMBODIMENTS

Referring to the drawings in particular, the invention embodied in FIG. 1 comprises an electrocution-proof line having a plug generally designated 10 at one end, a line cord 20 for conveying current and including redundant ground wires, and a socket 30 connected to the opposite end of the line cord.

While FIG. 1 shows an extension cord configuration for the present invention, the line cord 20 can be connected directly to appropriate connection sites of a device. The device may be an electric drill as shown on FIG. 4, any piece of hospital equipment that utilized electrical power, or any other electrical appliance or mechanism.

The main object of the invention is to provide a redundant ground line and extra connecting sites for the ground line to avoid any possible electrocution hazard. The invention takes into account the possible incorrect wiring of the plug, socket or device, as well a the possibility that the power outlet is improperly wired.

While the plug and socket shown in the drawings is primarily used for 120 volt outlets and devices, the principles of the invention can be applied equally to 220 volt plugs, sockets, devices and outlets. These require an additional power conveying blade, connection site and conductive wire, however.

Another advantage of the invention is that the redundant grounding wire provides a zero-potential grounding for patients which are sensitive to micro-shock. A further advantage is that the invention prevents a grounding circuit from burning open prior to the power circuit when a massive short occurs.

Returning to FIG. 1, the plug 10 comprises a housing 18 made of insulating material such as ABS plastic. Housing 18 defines an interior space which is closed by a back cover 19. Back cover 19 is transparent in the embodiment shown. First and second conductive blades 12 and 14 extend from housing 18 and have slotted ends 42 (one of which being shown in FIG. 1). As shown in FIG. 2, each of the slotted ends 42 for blade 12 and 13 is associated with a plate 45. A screw 44 is threaded into plate 45 and has a head which bears on an outer surface of slotted end 42. The conductive portion of a wire 22 is inserted through a hole 52 in the cover 19, and between the slotted end 42 and the plate 45. Screw 44 can be tightened to secure wire 22 to the plug. In likewise fashion, a second conductive wire 24 of the line cord 20 is connected to a second site between the slotted end of blade 14 and a plate associated with that end.

A grounding prong 16 also extends from housing 18 and includes a slotted end 46 inside the housing. A screw 48 is threaded into a plate 49 and has a head engaged against sloted end 46. A pair of grounding wires 26 and 28 extend through a pair of holes 54 in cover 19 and between slotted end 46 and plate 49. By tightening screw 48, both grounding wires 26 and 28 are electrically connected to the grounding prong 16.

As shown in FIG. 5, the current conveying wires 22 and 24 each have their own insulating sheeting as do the two grounding wires 26 and 28. The four wires are together housed within an outside insulating sheet 29.

As is conventional, the narrow blade 12 is the hot current conveying blade and is connected to a black wire 22. A white wire 24 is connected to the neutral or zero-potential blade 14.

Both of the grounding wires 26 and 28 which are connected to the grounding prong 16 should be green.

FIG. 2 shows the configuration of conductive blades 12 and 14 as well as the prong 16 which is preferably U-shaped in cross-section.

As shown in FIG. 1, socket (or female connector body) 30 comprises an insulated housing 38 defining interior space and covered by a back cover 39. Conductive blade receiving plates 32 and 34 are fixed in housing 38 as is a conductive prong receiving plate 36. Each of these have slotted ends, screws and associated connecting plates which are all within housing 38. Opposite ends of wires 22, 24, 26 and 28 extend through holes in the back cover 39 and to the respective connecting sites of the receiving plates 32, 34 and 36. As with plug 10, the two ground wires 26 and 28 are connected to two connection sites for prong receiving plate 36. The configuration is the same as FIG. 3 for the plug, with the two connection sites being on opposite sides of the tightening screw for the prong receiving plate 36.

FIG. 3 shows how the interior of housing 18 is subdivided into compartments each for receiving the slotted end, the tightening screw and the plate of one of the blades or prongs 12, 14, 16. In likewise fashion the housing 38 of socket 30 has compartments for receiving the slotted ends, tightening screws and plates of the blade and prong receiving plates 32, 34 and 36.

FIG. 4 shows a power outlet generally designated 60 having a hot connection terminal B, a neutral or zero-potential connection terminal W, and a ground connection terminal G which is electrically connected to the neutral terminal W. A schematically shown plug 10 is plugged into the outlet 60. The wires of the line cord 20 are shown connected to the connection sites of plug 10 and extending to the connecting sites of socket 30. Socket 30 is schematically shown connected to a plug 70 of a device, in this case, a hand drill 80. The line cord of hand drill 80 has two conductive wires connected to a motor 82 and two conductive wires connected to the housing 84 of the drill. It is noted that in wiring the circuit of FIG. 4, errors can be made anywhere along the circuit path from the outlet 60 to the drill 80. The outlet itself may be miswired, for example, by reversing the ground and neutral terminals or by reversing polarity of the hot and neutral terminals. Similar errors can be made for the plug 10 and socket 30 of the extension cord. Errors can also be made in the way plug 70 of drill 80 is wired and even in the way the conductive wires of the line cord for the drill are conducted to the motor and housing of the drill. It is noted that particularly in a hospital environment where equipment, outlets and extension cords are regularly wires, such errors can easily be made. Despite any conceivable error in wiring, however, by providing four connecting sites for the plug and socket, and four conducting wires for the line cord, at worst a circuit breaker or fuse will be blown. No electrocution hazard will occur.

It is noted that the present invention includes not only an extension cord but also a power cord. In this case, the female socket 30 and plug 70 in FIG. 4 would be removed and the wires 22, 24, 26 and 28 would be connected directly to corresponding connection sites of the drill 80.

Rather than using a single connecting screw for the ground prong and ground prong receptacle of the plug and socket of FIG. 1, separate screws can be provided. In either case, four connection sites are necessary on both structures.

What is claimed is:

1. An electrocution-proof line comprising, a plug having a housing with four wire connection sites, a first conductive blade extending from said plug housing and connected to a first one of said sites, a second conductive blade extending from said plug housing and connected to a second one of said sites, a grounding prong extending from said housing and connected to a third and to a fourth one of said sites, and a line cord having four conductive wires, each of said wires being connected respectively to one of said first, second, third and fourth sites, whereby two of said wires of said line cord act as grounding wires to provide a redundant grounding pathway for current.

2. A line according to claim 1, including a socket having a housing with four wire connection sites, a first conductive blade receiving plate in said socket housing connected to a first one of said sites in said socket housing, a second blade receiving plate in said socket housing connected to a second one of said sites of said socket housing, and a prong receiving plate in said socket housing connected to the third and fourth ones of said sites in said socket housing, ends of said wires of said line cord which are opposite from said plug being connected respectively to said first, second, third and fourth sites of said socket housing.

3. A line according to claim 1, wherein said first and second blades and said grounding prong each have an end in said plug housing, a plate adjacent each end of each blade and prong in said plug housing, a screw threaded to each plate and engaged against each respective end for said blades and prong.

4. A line according to claim 3, including a back cover connected to said plug housing and covering the interior space of said plug housing, said back cover having four holes therethrough, two of said holes being aligned with said end and plate of said grounding prong to form said third and fourth sites, and each remaining hole being aligned with one of said ends and plates of said first and second conductive blades of form said first and second sites.

* * * * *